United States Patent [19]

Lippold et al.

[11] Patent Number: 4,807,867

[45] Date of Patent: Feb. 28, 1989

[54] SHEET HANDLING APPARATUS

[75] Inventors: Steven R. Lippold, Oakfield; Armand R. Fenicchia, Rochester, both of N.Y.

[73] Assignee: Eastman Kodak Company, Rochester, N.Y.

[21] Appl. No.: 167,928

[22] Filed: Mar. 14, 1988

[51] Int. Cl.[4] ..... B65H 5/12

[52] U.S. Cl. ..... 271/277; 271/82

[58] Field of Search ..... 271/277, 82; 101/408–411; 346/125, 132, 138

[56] References Cited

U.S. PATENT DOCUMENTS

| | | | |
|---|---|---|---|
| 1,869,403 | 8/1932 | Bellucke | 271/277 |
| 3,637,202 | 1/1972 | Mowry et al. | 271/277 |
| 3,827,803 | 8/1974 | Shelffo et al. | 271/82 |
| 4,033,575 | 7/1977 | Fujimoto | 271/277 |
| 4,111,123 | 9/1978 | Willeitner | 271/277 |
| 4,132,403 | 1/1979 | Weisbach et al. | 271/82 |
| 4,357,870 | 11/1982 | Rudolph et al. | 271/277 |
| 4,501,415 | 2/1985 | Loebach | 271/82 |

*Primary Examiner*—H. Grant Skaggs
*Attorney, Agent, or Firm*—Dennis P. Monteith

[57] ABSTRACT

Apparatus for rotating a flexible sheet of material includes a rotatable axle and a generally cylindrical drum mounted on the axle for rotation therewith. A generally cylindrical cam is secured to an end surface of the drum for rotation therewith, the cam defining at least one indentation extending towards the axle. A cam follower is provided positioned to generally follow the cam. A clamp normally biased against the surface of the drum for securing a first edge of the sheet material to the drum is provided. A biasing cam is journaled to the end surface of the drum in the cam indentation, the biasing cam responsive to pressure from the cam follower for biasing the clamp away from the drum surface so as to enable the positioning of an edge of the flexible sheet of material between the clamp and the surface of the drum. Holding structure is provided for selectively holding the cam follower stationary relative to the cam, such that the cam follower can be selectively engaged with the biasing to control the position of the clamp cam.

9 Claims, 7 Drawing Sheets

SHEET HANDLING APPARATUS

FIELD OF THE INVENTION

The invention relates generally to sheet material handling and more specifically to apparatus for securing a flexible sheet of material to a rotatable drum surface.

BACKGROUND OF THE INVENTION

Many applications require the temporary securing of a flexible sheet of material to a rotatable drum. Apparatus such as electrostatic copiers and facsimile machines, for example, often employ a drum-type mechanism for supporting a sheet of paper or film during reading and writing processes.

U.S. Pat. No. 4,033,575 to Fujimoto shows one type of automatic sheet feed and delivery apparatus employing a rotatable drum for supporting the sheet. Fujimoto includes leading and trailing edge clamps for securing the sheet to the drum, and a variety of complex, movable, rotatable cam and lever mechanisms for controlling these clamps. The apparatus shown in the Fujimoto patent suffers from the disadvantage of being extremely complex in construction and operation.

SUMMARY OF THE INVENTION

The principle object of the present invention is to provide a new and improved apparatus for mounting a flexible sheet of material securely to a rotatable drum.

Another object of the present invention is to provide an apparatus for supporting a flexible sheet of material securely on a rotatable drum wherein the sheet is loaded onto the drum with no contact to the major area of the outfacing sheet surface.

A further object of the present invention is to provide an apparatus for securing a sheet of flexible material to a drum which is particularly suited for high-speed rotation of said drum.

In accordance with the present invention, new and improved apparatus for rotating a flexible sheet of material is provided, comprising a rotatable axle and a drum having a generally cylindrical surface mounted on said axle for rotation with said axle. A generally cylindrical cam is secured to an end surface of the drum for rotation with the drum, the cam defining at least one cam indentation extending towards the axle. A cam follower is positioned to generally follow the cam. Clamp means normally biased against the surface of the drum are provided for securing a first edge of the sheet material to the drum. Biasing means are provided journaled to the end surface of the drum in the cam indentation. The biasing means are responsive to pressure from the cam follower for biasing the clamp means away from the drum surface so as to enable the insertion of a first edge of the flexible sheet of material between the clamp means and the surface of the drum. Holding means are provided for selectively holding the cam follower stationary relative to the rotation of the cam such that the cam follower can be selectively engaged with the biasing means to control the position of the clamp means.

BRIEF DESCRIPTION OF THE FIGURES

While the specification concludes with claims defining the features of the invention that are regarded as novel, it is believed that the invention, together with further objects thereof, will be better understood from a consideration of the drawing Figures, in which like reference numerals are carried forward, and in which:

DETAILED DESCRIPTION OF THE INVENTION

Figure 1:
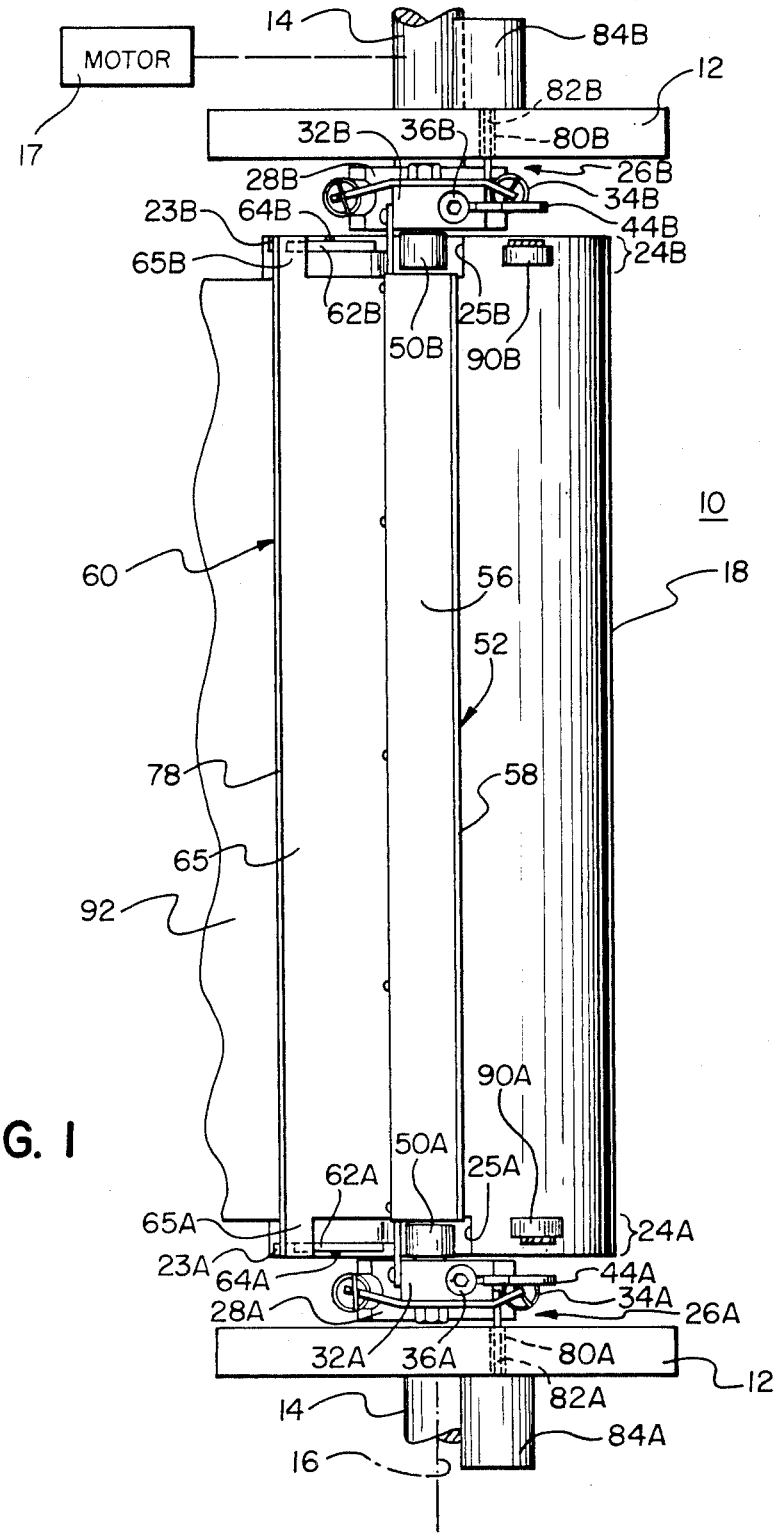
FIG. 1 is a top view of a sheet material handling apparatus constructed in accordance with the present invention.
Figure 2A:
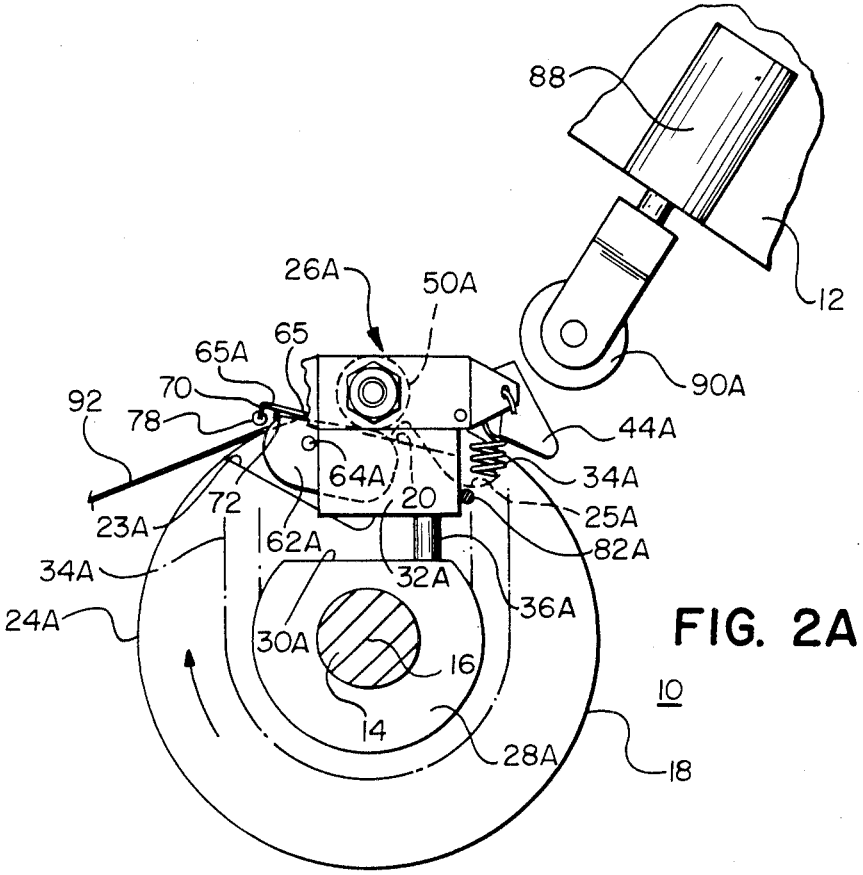
FIG. 2A is a side view of FIG. 1, showing the sheet material handling mechanism positioned to secure a sheet of material.
Figure 2B:
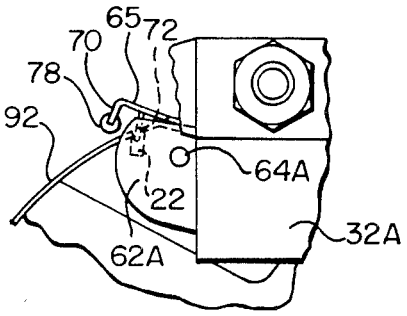
FIG. 2B is a detail view of a portion of FIG. 2A.

Referring now to the drawings, FIGS. 1 and 2, show a sheet handling apparatus 10 including a frame 12 (partly cut away in FIG. 2) supporting an axle 14 for rotation about an axis 16. A motor 17, for example a D.C. motor, is connected to axle 14 in a conventional manner for rotating the axle. A drum 18, substantially cylindrical in shape, is mounted concentrically on axle 14 for rotation therewith. Drum 18 defines one axially extending, flattened surface region 20 FIG. 2A having a channel 22 FIG. 2B disposed the length thereof. A pair of identical cams, initiated at 24A, 24B are secured to or machined into the longitudinal end surfaces of drum 18. Cams 24A, 24B define two generally pie-shaped indentations 23A, 23B surrounding channel 22, and two generally U-shaped indentations 25A, 25B proximate the right-most edge (as viewed in FIG. 2) of drum region 20. As is visible in FIG. 1, cam indentations 25A, 25B extend a relatively further axial distance (i.e. are wider) than cam indentations 23A, 23B. Axle 14, drum 18, and cams 24A, 24B can comprise, for example, an integral piece of appropriately machined steel.

A pair of identical brackets, indicated at 26A, 26B, are captured on axle 14 intermediate cams 24A, 24B and the respective inside ends of frame 12. Brackets 26A, 26B are frictionally mounted on axle 14 in a manner permitting independent rotation about axis 16 relative to the axle. For purposes of explanation, the construction of the brackets will be discussed with respect to bracket 26A. In the FIGS., identical features of bracket 26B are indicated with like reference numerals followed by a "B".

Figure 3:
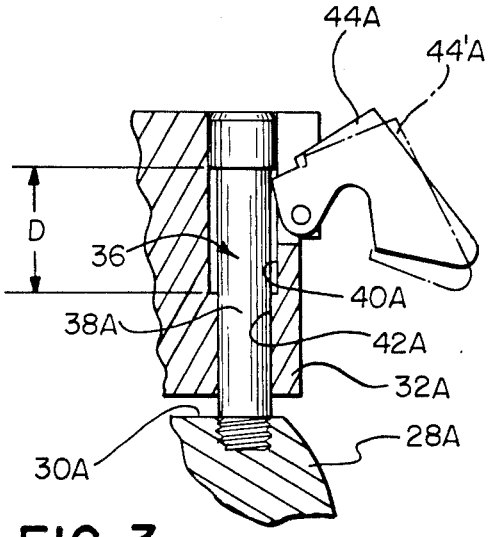
FIG. 3 is a side detail view of the centrifugal locking mechanism associated with the trailing edge clamp of FIGS. 1 and 2.

Bracket 26A includes a sleeve 28A, including a flat surface 30A, mounted in frictional rotational engagement on axle 14. Sleeve 28A comprises, for example, brass. A generally T- shaped brace 32A is secured to sleeve 28A by a spring 34A, the base of the T opposing flat surface 30 of sleeve 28A. Spring 34A extends circumferentially around sleeve 27 and is fixed to brace 32A at opposing ends of the T cross. As is best visible in detail FIG. 3, brace 32A is further secured to surface 30A of sleeve 28A via a shoulder bolt 36A having a smooth shaft region 38A. A smooth bore 40A is defined in brace 32A for accepting the shaft and head of bolt 36A in sliding relationship, with the base of the bore, indicated at 42A, being decreased in diameter to prevent the head of the bolt from passing there through. A locking pawl, shown in locked position in solid line 44A and in unlocked position in dashed line 44'A, is journaled to brace 32A adjacent bolt 36A. In operation, spring 34A tends to bias brace 32A towards flat surface 30A of sleeve 28A. With the locking pawl in the normal, unlocked position 44'A, brace 32A can separate (working against the bias of spring 34) from sleeve 28A by at least the distance D of the bore 40A. However, when the locking pawl is in the locked position 44A, it forms a wedge between the head of bolt 36A and restricted bore portion 42A, preventing brace 32A from separating more than a very short distance from sleeve surface 30A. The operation of locking pawls 44A, 44B will be described in greater detail hereinbelow.

Figure 4:
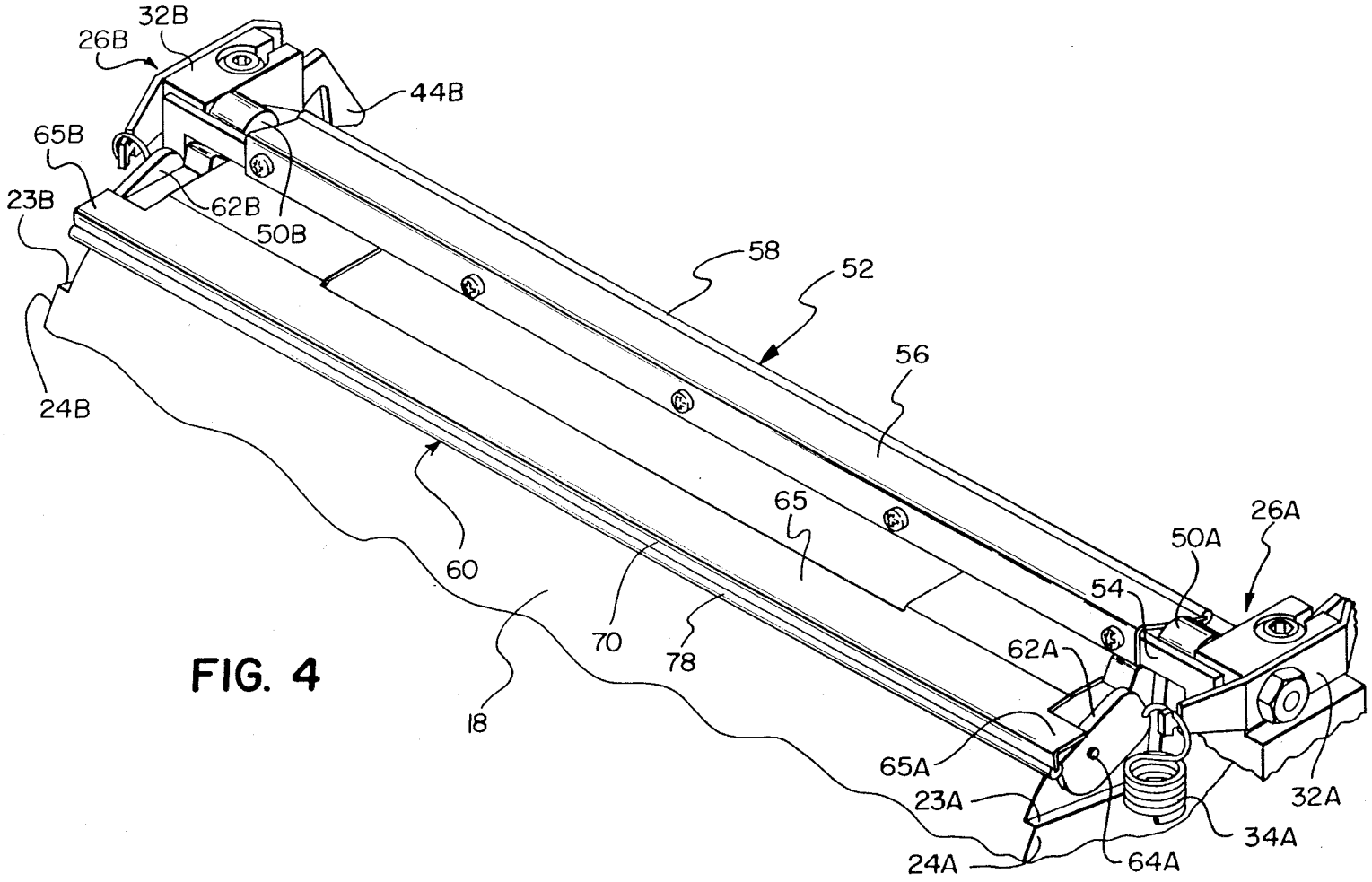
FIG. 4 is a perspective view of the trailing edge clamp of FIGS. 1 and 2 shown in a clamped position.

As is best shown in FIGS. 1 and 4, journaled onto the T-cross of each brace 32A, 32B is a cam follower/roller 50A, 50B, respectively. As will be described in further detail hereinbelow, cam followers 50A, 50B are positioned so as to overlap the edge of the circumferential surface of drum 18, and to follow cam indentations 25A, 25B, and the drum surface. Further supported between the T-crosses of braces 32A, 32B is a trailing edge clamp 52. Clamp 52 comprises a support bracket 54 in the shape of a rectangular beam of relatively stiff material extending between the T-crosses of braces 32A, 32B. Bracket 54 comprises, for example, steel. Fastened to bracket 54 is an arcuate claw 56 of flexible metal, comprising, for example, spring steel. Claw 56 arcs downward towards drum 18, extending the length thereof between cam followers 50A, 50B. A soft, flexible bead 58, for example urethane or silicone, is disposed on the longitudinal edge of claw 56 opposite bracket 54. Trailing edge clamp 52 is sized and positioned between braces 32A, 32B such that, when cam followers 50A, 50B are situated in cam indentations 25A, 25B, beaded edge 58 of claw 56 contacts the surface of drum 18 in a secure manner. The operation of trailing edge clamp 52 is described in further detail below.

Figure 5:
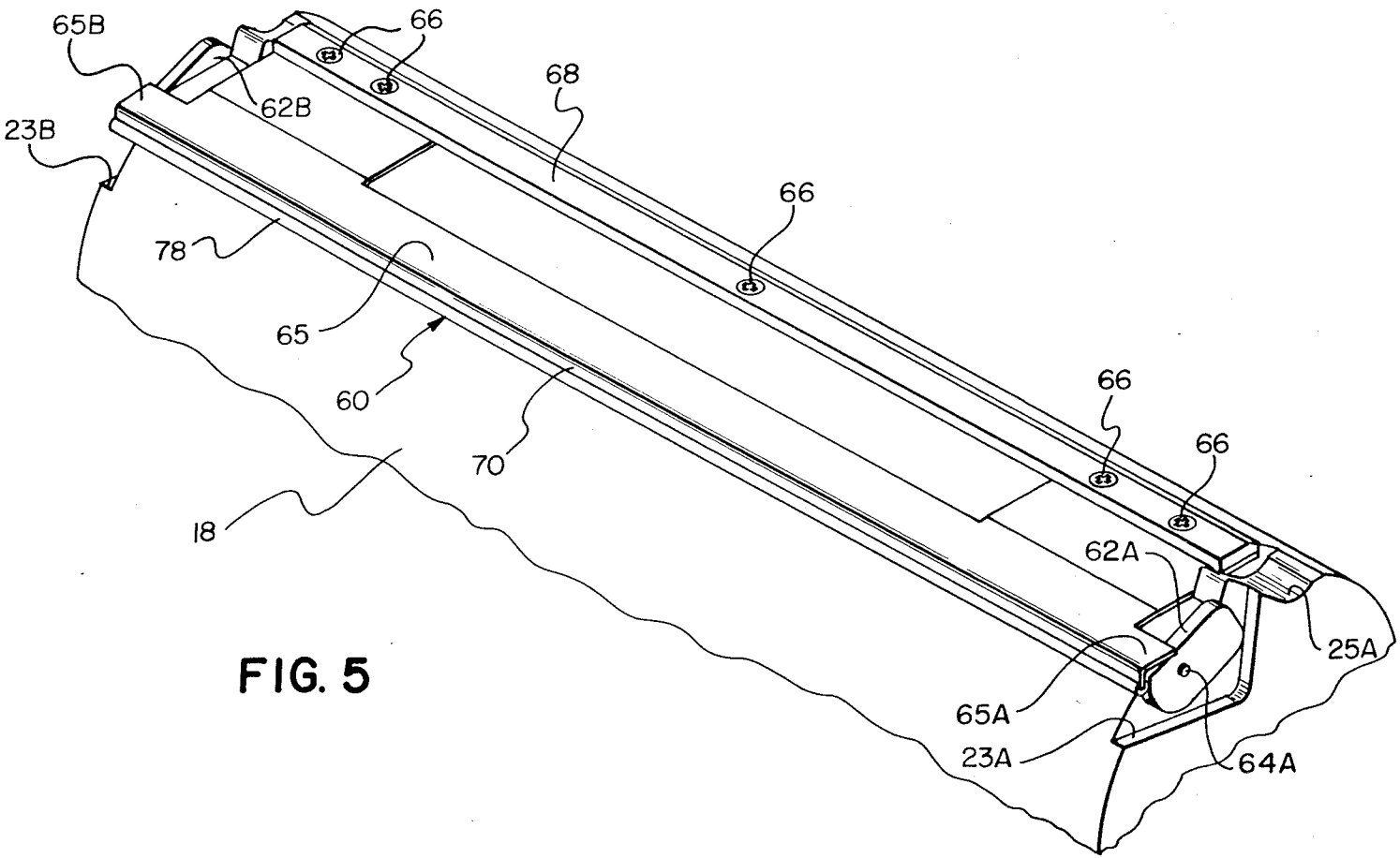
FIG. 5 is a perspective view of the leading edge clamp of FIGS. 1 and 2.

As is best shown in FIGS. 1, 4, and 5, extending the length of drum 18 is a leading edge clamp assembly 60. Leading edge clamp assembly 60 includes identical cams 62A, 62B, shaped generally rectangularly with rounded corners, journaled eccentrically to the end surfaces of drum 18 within cam indentations 23A, 23B, respectively, by pivot axles 64A, 64B. Cams 62A, 62B are sized such that the highest surface (i.e. the surface spaced furthest from axis 16) sets higher than flat surface region 20 of drum 18. Leading edge clamp assembly 60 further includes a flexible metal retaining claw 65 extending the length of flat drum surface region 20 and fastened to an edge thereof via the use of screw-type fasteners 66 extending through a stiff, reinforcing bar 68. The outer-most tips of claw 65, indicated at 65A, 65B, extend to overlie cams 62A, 62B, respectively. Retaining claw 65 comprises, for example, spring steel. Retaining claw 65 includes, extending along the longitudinal edge spaced from reinforcing bar 68, outer and inner lips 70, 72, respectively, extending downward towards surface 20 of drum 18. Retainer claw 65 is sized and positioned such that inner lip 72 engages channel 22 in drum surface 20, while outer lip 70 extends along the edge of drum surface 20 spaced from reinforcing bar 68. Claw lip 70 preferably supports a smooth, soft coating or bead 78, for example of urethane.

In operation, with cams 62A, 62B unbiased, retaining claw 65 is, by the force of its inherent structure, pressed securely against drum surface 20 with lip 72 recessed in channel 22, and with lip bead 78 pressed securely against the surface of drum 18. As will be described in detail below, biasing cams 62A, 62B in the appropriate manner has the effect of pivoting tips 65A, 65B so as to separate retaining claw lips 70, 72 from the surface of drum 18.

Referring now to FIGS. 1 and 2A, frame 12 defines two apertures, 80A, 80B on opposite sides of drum 18. Situated in sliding engagement in apertures 80A, 80B are two pins 82A, 82B, respectively. Each pin 82A, 82B is connected to a corresponding solenoid 84A, 84B. Apertures 80A, 80B are positioned such that, upon the actuation of solenoids 84A, 84B, pins 82A, 82B are driven into the space between frame 12 and cams 24A, 24B, respectively. The position of pins 82A, 82B is further selected such that, upon insertion into the above-described space, they contact the T-base of braces 32A, 32B, blocking the rotation of brackets 26A, 26B, respectively.

As is shown in FIG. 2A, frame 12 further supports a solenoid 88 connected to a pair of rollers 90A, 90B. Solenoid 88 and rollers 90A, 90B are positioned such that, upon the actuation of the solenoid, the rollers are driven into contact with drum surface 18 adjacent cams 24A, 24B, respectively. The operation of rollers 90A, 90B is described in further detail below.

In operation, drum 18 functions to support a flexible sheet 92 of material, such as a photographic negative or transparency film, for rotation about axis 16. The operation of apparatus 10 is thus initiated by loading sheet material 92 onto drum 18 in the manner shown in FIGS. 2A, 2B, 6, and 7.

Referring first to FIGS. 2A and B, the loading of sheet material 92 is begun by activating solenoids 84A, 84B to drive pins 82A, 82B into the space between frame 12 and cams 24A, 24B, respectively. Drum 18 is then rotated in a clockwise direction until pins 82A, 82B abut the T-base of braces 32A, 32B, thereby preventing the continued rotation of brackets 26A, 26B. Subsequently, as the rotation of drum 18 is continued in a clockwise direction, cam followers 50A, 50B follow drum surface region 20 over cam indentations 23A, 23B, engaging and biasing the right-most edge/corner (as viewed in FIG. 2) of cams 62A, 62B towards axis 16. The rotation of drum 18 is stopped, and the biasing force exerted by cam followers 50A, 50B on cams 62A, 62B forces these cams to rotate clockwise about their pivot axles 64A, 64B. This clockwise rotation of cams 62A, 62B pivots claw tips 65A, 65B away from surface region 20 of drum 18, in turn causing beaded edge 78 of claw lip 70 to also lift away from the drum. The edge of material sheet 92 is then positioned between claw 65 and drum 18, so as to abut inner claw lip 72 in the manner shown in FIG. 2B.

Figure 6:
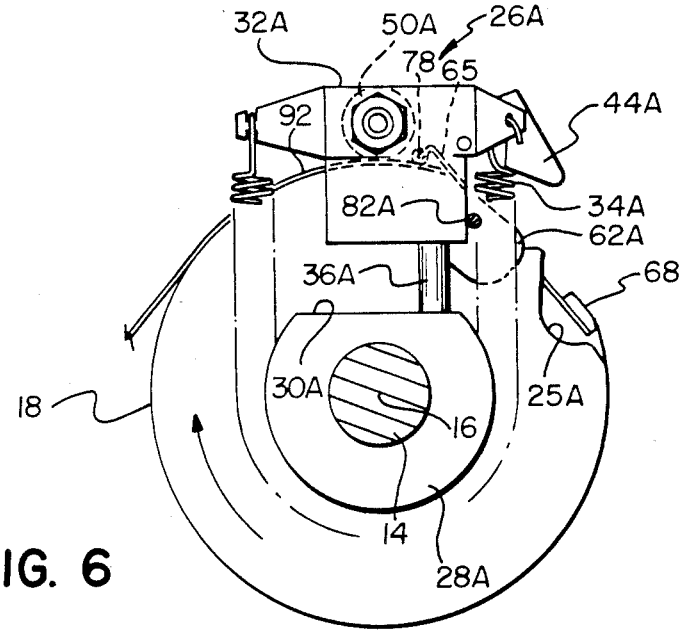
FIGS. 6 and 7 are side views of the sheet material handling mechanism illustrating the loading of a sheet of material.

Referring now to FIG. 6, with pins 82A, 82B maintained in the position described above, the clockwise rotation of drum 18 is continued. Cam followers 50A, 50B, being prevented from clockwise rotation in the manner described above, roll off of cams 62A, 62B, away from cam indentations 23A, 23B, and onto the cylindrical surface region of drum 18. The biasing force of cam followers 50A, 50B being removed from cams 62A, 62B, the inherent force in deformed claw 65 causes it to return to its position in pressure contact with drum 18. The leading edge of material sheet 92 is thus securely gripped between beaded edge 78 of claw 65 and drum 18 in the manner shown in FIG. 6.

Figure 7:
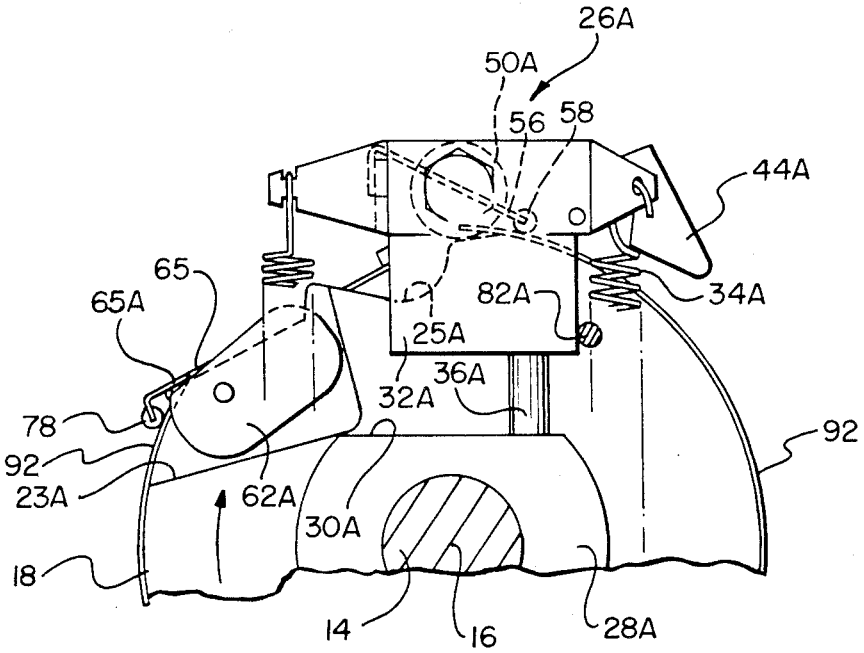

Referring now to FIG. 7, pins 82A, 82B are maintained in the above-described position while the clockwise rotation of drum 18 is continued. Clam followers 50A, 50B thus continue to follow the edge of drum 18, pressing the outermost edges of sheet material 92 smoothly along the edges of the drum. Material sheet 92 is in this manner "wrapped" onto the cylindrical surface portion of drum 18. As drum 18 approaches a 360 degree rotation, cam followers 50A, 50B begin to ramp down into cam indentations 25A, 25B. As this ramp-down begins, and cam followers 50A, 50B move towards axis 16, beaded edge 58 of trailing edge clamp 52 contacts the trailing edge of material sheet 92. As cam followers 50A, 50B continue to roll down towards axis 16, leading edge clamp 52 exerts a pulling force on the trailing edge of material sheet 92, pulling the sheet smoothly and tightly about drum 18. This ramping-down action is shown in FIG. 7. A significant advantage of the present invention is that material sheet 92 is loaded onto drum 18 via contact with cam followers 50A, 50B made only at the outermost edges of the sheet. Such loading prevents any damage from contact-related abrasion to all but the very edges of material sheet 92.

Figure 8:
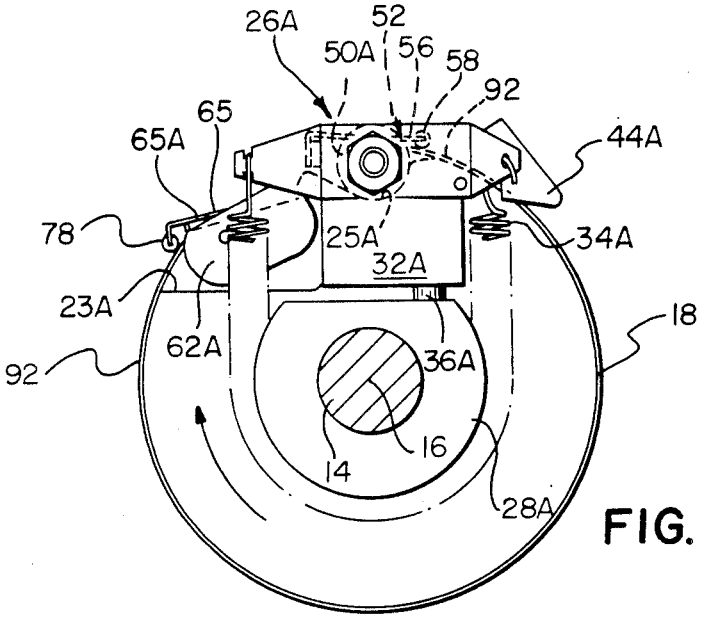
FIG. 8 is a side view of the sheet material handling mechanism showing the loaded material sheet being rotated for processing.

Referring now to FIG.8, upon completion of the loading of material sheet 92 onto drum 18, solenoids 84A, 84B are activated to withdraw pins 82A, 82B from the space between frame 12 and the drum. Motor 17 (FIG. 1) is then controlled to rotate drum 18 at a high speed in the clockwise direction. For typical photographic printing operations, speeds in the range of 1000–2000 revolutions per minute (RPMs) are desirable. With pins 82A, 82B withdrawn, and cam rollers 50A, 50B situated in cam indentations 25A, 25B, brackets 26A, 26B rotate counterclockwise with drum 18, and trailing edge clamp 52 is maintained in contact with the trailing edge of material sheet 92.

Referring back to FIG. 3 and the description thereof above, the centrifugal force generated by this high-speed rotation of drum 18 causes locking pawls 44A, 44B, to pivot into the locked position, preventing braces 32A, 32B from moving away from the drum. This centrifugal locking feature prevents the centrifugal force generated by the rotation of drum 18 from lifting braces 32A, 32B, and hence trailing edge clamp 54, away from the surface of drum 18. The invention thus provides the significant advantage of being suitable for applications requiring high-speed rotation in the range of 1000–2000 RPMs.

Upon completion of exposure or other processing of material sheet 92, it is necessary to unload the sheet from drum 18. This process is illustrated in FIGS. 9–11 as described below.

Figure 9:
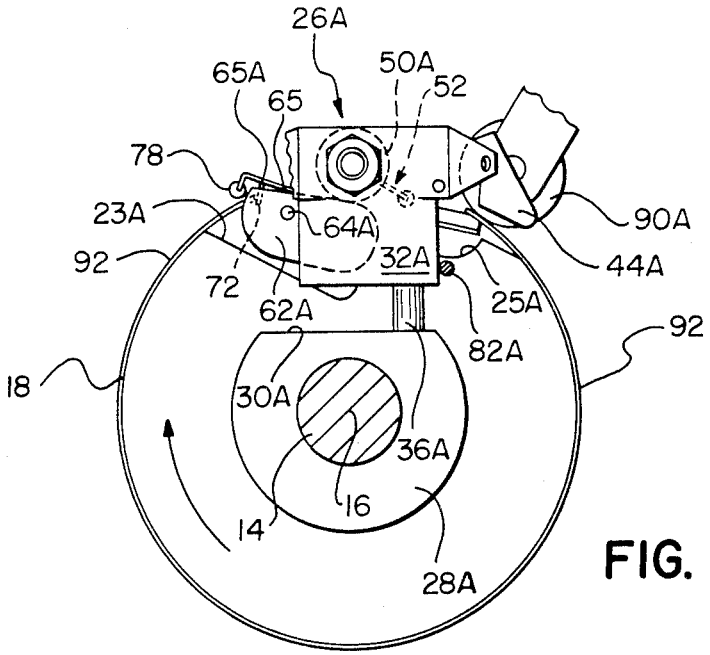
FIGS. 9–11 are side views of the sheet material handling mechanism showing the unloading of the material sheet after processing.

Referring now to FIG. 9, to initiate the unloading of material sheet 92, solenoids 84A, 84B are activated to drive pins 82A, 82B back into the locking position described with respect to FIGS. 1–7 above. Drum 18 is rotated in a clockwise direction, and substantially simultaneously, solenoid 88 is activated to position rollers 90A, 90B in contact with the outer edges of material sheet 92. As drum 18 rotates in a clockwise direction, pins 82A, 82B block the rotation of braces 32A, 32B, causing cam followers 50A, 50B to roll out of cam indentations 25A, 25B, lifting trailing edge clamp 52 away from drum 18 and hence releasing the trailing edge of material sheet 92. As drum 18 continues its clockwise rotation, cam followers 50A, 50B proceed to roll over cam indentations 23A, 23B. In a manner identical to that described above with respect to FIG. 2, cam followers 50A, 50B engage cams 62A, 62B, exerting a biasing pressure thereon and lifting claw 65 of leading edge clamp 60 clear of drum 18. At this point in the unloading process, material sheet 92 is held in compression between inner lip 72 of leading edge clamp 60 and rollers 90A, 90B in the manner shown in FIG. 9.

Figure 10:
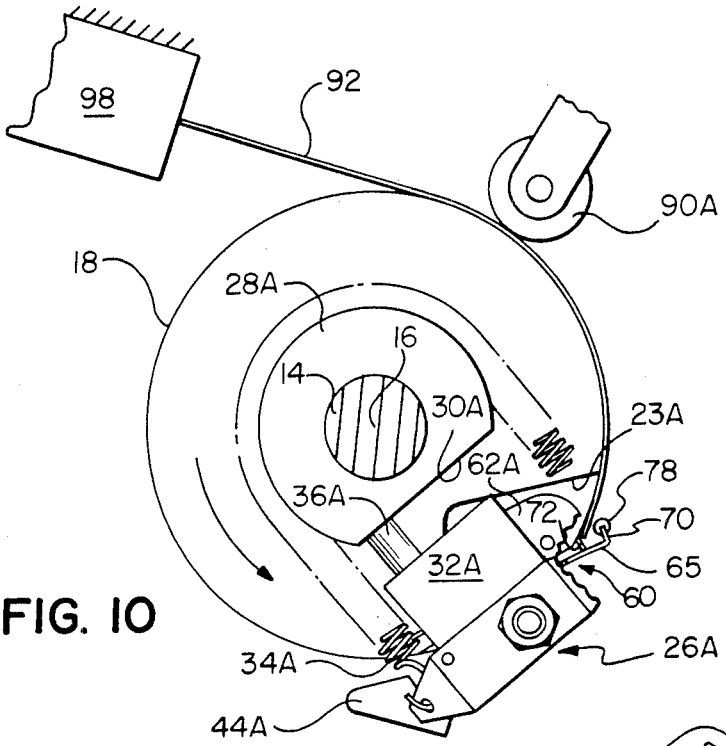
Figure 11:
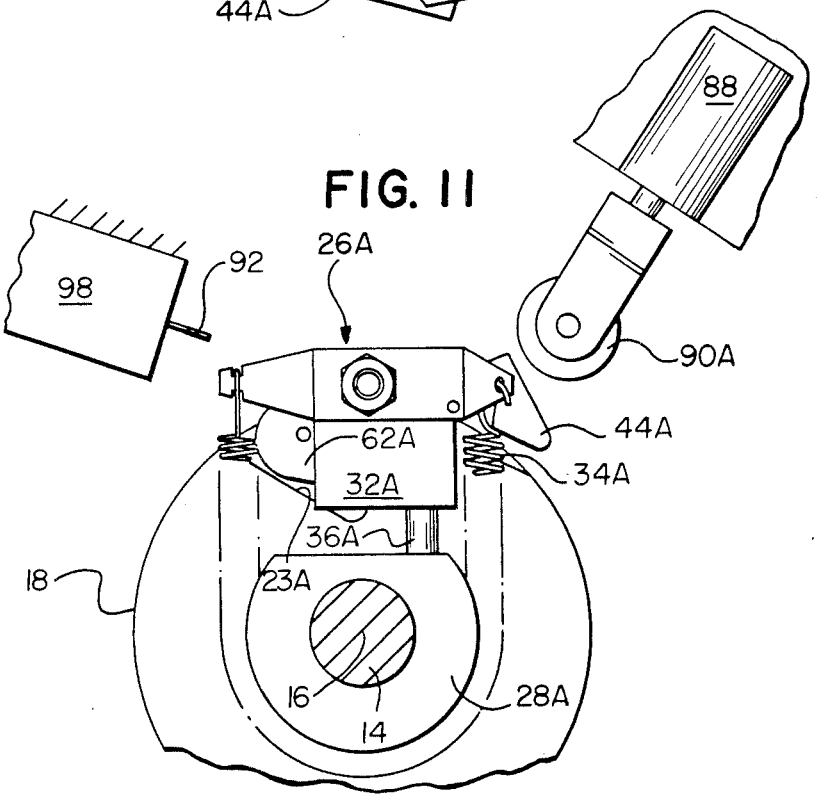

Referring now to FIGS. 10 and 11, drum 18 is rotated in the counter-clockwise direction as film 92 is guided by rollers 90A, 90B off of the drum and into, for example, a light-tight cassette 98. As drum 18 nears the completion of a 360 degree revolution in the counter-clockwise direction, solenoid 88 is activated to withdraw rollers 90A, 90B from the surface of drum 18, and leading edge clamp 60 pushes material sheet 92 completely into cassette 98 (FIG. 11).

In an alternative method of operation to that shown in FIGS. 9, 10, and 11, solenoid pins 82A, 82B can be controlled to release trailing edge clamp 52 while leaving leading edge clamp 60 secured until film 92 is substantially entirely backed off of drum 18. Pins 82A, 82B are actuated at the last minute to release film 92 into cassette 98. This mode of operation has the advantage of securely pushing film 92 into cassette 98.

There is thus provided a drum apparatus for supporting and rotating a flexible sheet of material at relatively high rotational speeds. In comparison to the prior art, the drum apparatus is relatively simple in construction, and has relatively few movable components. The drum apparatus further operates to handle the flexible sheet of material while contacting only the outermost edges thereof, minimizing any possible damage to the material.

While a preferred embodiment of the invention has been illustrated and described, it will be clear that the invention is not so limited. Numerous modifications, changes, variations, substitutions, and equivalents will occur to those skilled in the art without departing from the spirit and scope of the present invention.

What is claimed is:

1. Apparatus for rotating a flexible sheet of material comprising:

a rotatable axle;

a drum having a generally cylindrical surface mounted on said axle for rotation with said axle;

a cam secured to an end surface of said drum for rotation with said drum, said cam defining at least one cam indentation extending towards said axle;

a cam follower positioned to generally follow said cam;

clamp means normally biased against the surface of said drum for securing a first edge of said sheet material to said drum;

biasing means journaled to said end surface of said drum in said cam indentation, said biasing means responsive to pressure from said cam follower for biasing said clamp means away from said drum surface so as to enable the insertion of a first edge of said flexible sheet of material between said clamp means and the surface of said drum; and holding means for selectively holding said cam follower stationary relative to the rotation of said cam such that said cam follower can be selectively engaged with said biasing means to control the position of said clamp means.

2. Apparatus in accordance with claim 1 wherein:
said cam is generally cylindrical;
said cam and said drum are coaxially aligned and of generally equal circumferences;
said cam follower is further positioned to overlap the edge of said drum surface such that said cam follower follows the higher of said cam or said drum surface; and
said drum surface defines a flat region overlying at least a portion of said cam indentation.

3. Apparatus in accordance with claim 2 wherein said biasing means comprises:
a second cam eccentrically journaled to the end surface of said drum in said cam indentation, said second cam including a surface region normally positioned higher than said flat region of said drum; and
means for connecting said second cam to said clamp means.

4. Apparatus in accordance with claim 2 wherein said cam further defines a second cam indentation extending towards said axle and adjacent said one cam indentation, and further including second clamp means secured to said holding means and responsive to the positioning of said cam follower in said second cam indentation for engaging the surface of said drum so as to secure a second edge of said flexible sheet of material to said drum.

5. Apparatus in accordance with claim 4 and wherein said second clamp means is positioned such that, as said cam follower ramps down into said second cam indentation, said second clamp means engages and pulls said second edge of said flexible sheet of material so as to pull said flexible sheet of material tightly onto said drum.

6. Apparatus in accordance with claim 1 wherein said holding means comprises a bracket mounted in frictional rotational relationship on said axle and supporting said cam follower.

7. Apparatus in accordance with claim 6 wherein said holding means further comprises means for selectively holding said bracket stationary relative to said axle.

8. Apparatus in accordance with claim 6 wherein said holding means further comprises:
a brace supporting said cam follower and spaced from said bracket;
means for connecting said brace to said bracket so as to permit said brace to move in a direction perpendicular to said axle; and
means for biasing said brace towards said bracket.

9. Apparatus in accordance with claim 1 wherein said cam follower is further positioned to follow the edges of the cylindrical surface of said drum such that, when said holding means is activated to hold said cam follower stationary, said cam follower presses the edges of said flexible sheet of material to said drum.

* * * * *